US008043498B2

(12) United States Patent
Rueda

(10) Patent No.: US 8,043,498 B2
(45) Date of Patent: Oct. 25, 2011

(54) STORM DRAIN PROTECTOR

(75) Inventor: John Rueda, Elk Grove, CA (US)

(73) Assignee: John Rueda, Elk Grove, CA (US)

( * ) Notice: Subject to any disclaimer, the term of this patent is extended or adjusted under 35 U.S.C. 154(b) by 0 days.

(21) Appl. No.: 12/869,473

(22) Filed: Aug. 26, 2010

(65) Prior Publication Data

US 2011/0049027 A1 Mar. 3, 2011

Related U.S. Application Data

(60) Provisional application No. 61/237,230, filed on Aug. 26, 2009.

(51) Int. Cl.
*E03F 5/06* (2006.01)

(52) U.S. Cl. ..... 210/164; 210/348

(58) Field of Classification Search ..... None
See application file for complete search history.

(56) References Cited

U.S. PATENT DOCUMENTS 459,259 A * 9/1891 Shunk ..... 210/163
1,292,856 A * 1/1919 Niblo ..... 4/287
1,858,231 A * 5/1932 Parshall ..... 210/154
1,996,279 A * 4/1935 Dillon ..... 4/292
2,506,669 A * 5/1950 Heuacker ..... 4/292
2,690,569 A * 10/1954 Henry ..... 4/292
2,792,115 A * 5/1957 Medearis ..... 209/223.1
3,018,845 A * 1/1962 Powers ..... 96/99
3,209,913 A * 10/1965 Burgin ..... 210/154
3,815,341 A * 6/1974 Hamano ..... 55/477
3,959,831 A * 6/1976 Hendricks ..... 4/287
4,035,297 A * 7/1977 Aldridge et al. ..... 210/163
4,057,500 A * 11/1977 Wager ..... 210/170.07
4,301,554 A * 11/1981 Wojcicki ..... 4/679
4,416,782 A * 11/1983 Kerres ..... 210/634
4,418,432 A 12/1983 Vidal
4,490,862 A * 1/1985 Vidal ..... 4/292
4,658,449 A * 4/1987 Martin ..... 4/496
4,671,976 A * 6/1987 Vidal ..... 428/41.8
4,750,999 A * 6/1988 Roberts et al. ..... 210/266
4,793,923 A * 12/1988 Kadoya et al. ..... 210/491
4,822,658 A * 4/1989 Pacione ..... 428/95
4,825,477 A * 5/1989 Aranda ..... 4/286
4,838,732 A 6/1989 Clark et al.
4,866,793 A * 9/1989 Luedtke et al. ..... 4/300.3
4,906,263 A * 3/1990 von Blucher et al. ..... 96/135
4,981,501 A * 1/1991 Von Blucher et al. ..... 96/153
5,003,642 A * 4/1991 Robb et al. ..... 4/287
D329,893 S * 9/1992 Luedtke et al. ..... D23/310
5,192,426 A * 3/1993 DeCoster et al. ..... 210/117
D341,413 S * 11/1993 Nichols ..... D23/261
5,297,299 A * 3/1994 Wilson ..... 4/290
5,313,672 A * 5/1994 Luedtke et al. ..... 4/301
5,345,741 A * 9/1994 Slater et al. ..... 52/646
5,375,940 A * 12/1994 Kobayashi ..... 404/2
5,376,264 A * 12/1994 Betancourt ..... 210/166
5,382,462 A * 1/1995 Pacione ..... 428/95
5,398,347 A * 3/1995 Luedtke et al. ..... 4/301
5,403,474 A * 4/1995 Emery ..... 210/163
5,460,867 A * 10/1995 Magnuson et al. ..... 428/178
5,480,254 A * 1/1996 Autry et al. ..... 404/2

(Continued)

*Primary Examiner* — Robert James Popovics

(57) ABSTRACT

A storm drain protector with a top layer having a generally horizontal surface in which there is at least one hole that allows water to pass vertically through the surface. The horizontal surface also has several vertical projections emanating from the surface that permit the passage of water over the surface while impeding the passage of debris.

1 Claim, 6 Drawing Sheets

U.S. PATENT DOCUMENTS 5,604,937 A * 2/1997 Davenport ..... 4/309
5,632,888 A * 5/1997 Chinn et al. ..... 210/163
5,725,782 A * 3/1998 Chinn et al. ..... 210/767
D393,896 S * 4/1998 Wagner et al. ..... D23/261
5,774,905 A * 7/1998 Wager et al. ..... 4/309
5,820,762 A * 10/1998 Bamer et al. ..... 210/661
5,843,306 A * 12/1998 Singleton ..... 210/163
5,954,952 A 9/1999 Strawser, Sr.
6,010,622 A * 1/2000 Chinn et al. ..... 210/164
6,059,964 A * 5/2000 Strawser, Sr. ..... 210/164
D427,295 S * 6/2000 Wagner ..... D23/307
6,086,758 A 7/2000 Schilling et al.
6,088,844 A * 7/2000 Killham ..... 4/295
D441,064 S * 4/2001 Donnelly ..... D23/304
6,214,216 B1 * 4/2001 Isaacson ..... 210/162
6,217,757 B1 4/2001 Fleischmann
6,261,445 B1 * 7/2001 Singleton ..... 210/163
6,338,595 B1 * 1/2002 Schollen ..... 405/125
6,368,017 B2 * 4/2002 Black ..... 405/15
D464,122 S * 10/2002 Mangan ..... D23/261
6,464,862 B2 * 10/2002 Bennett ..... 210/155
6,487,729 B2 * 12/2002 Delanzo ..... 4/286
6,530,722 B1 3/2003 Shaw et al.
6,537,446 B1 * 3/2003 Sanguinetti ..... 210/163
6,551,505 B2 * 4/2003 Chinn et al. ..... 210/164
6,640,350 B1 * 11/2003 Deutsch ..... 4/309
6,706,172 B2 * 3/2004 Strawser, Sr. ..... 210/164
6,709,579 B1 * 3/2004 Singleton et al. ..... 210/163
6,793,811 B1 * 9/2004 Fleischmann ..... 210/163
6,808,623 B2 * 10/2004 Harris et al. ..... 210/164
6,908,549 B2 * 6/2005 Middleton et al. ..... 210/164
6,974,540 B1 * 12/2005 Fleischmann ..... 210/163
7,005,061 B1 * 2/2006 Downs et al. ..... 210/163
D520,610 S * 5/2006 Wrate ..... D23/261
7,070,691 B2 * 7/2006 Lindemulder ..... 210/164
7,074,326 B2 * 7/2006 Singleton ..... 210/163
7,108,783 B2 * 9/2006 Glazik ..... 210/163
7,156,987 B1 1/2007 Sanguinetti
7,186,333 B2 * 3/2007 Kluge ..... 210/164
7,201,843 B2 4/2007 Sasaki et al.
7,208,082 B2 * 4/2007 Hurst et al. ..... 210/164
7,246,968 B1 * 7/2007 Priest ..... 404/2
7,276,156 B2 10/2007 Lockerman et al.
7,300,573 B1 * 11/2007 Trangsrud ..... 210/163
7,357,861 B2 4/2008 Kelley et al.
7,398,565 B1 * 7/2008 Chou ..... 4/310
7,404,690 B2 * 7/2008 Lukasik et al. ..... 404/36
7,419,588 B2 * 9/2008 Lawson ..... 210/164
7,438,802 B2 * 10/2008 Hurst ..... 210/163
7,455,474 B2 * 11/2008 Tievant et al. ..... 404/25
7,481,921 B2 1/2009 Kent
7,549,820 B1 * 6/2009 Happel ..... 404/4
7,563,364 B2 * 7/2009 Shaw et al. ..... 210/163
7,614,198 B1 * 11/2009 Piskula et al. ..... 52/741.1
7,725,960 B2 * 6/2010 Markaj ..... 4/289
7,730,685 B1 * 6/2010 Keene ..... 52/302.4
7,820,041 B2 * 10/2010 Hilton et al. ..... 210/163
7,854,838 B2 * 12/2010 Martin ..... 210/163
D630,714 S * 1/2011 Dukes ..... D23/260
7,879,233 B2 * 2/2011 Shaw et al. ..... 210/164
7,922,916 B1 * 4/2011 Witt ..... 210/162
7,959,799 B2 * 6/2011 Happel et al. ..... 210/163
2001/0023842 A1 * 9/2001 Singleton ..... 210/163
2001/0047955 A1 * 12/2001 Chinn et al. ..... 210/164
2002/0020658 A1 * 2/2002 Isaacson ..... 210/162
2002/0130070 A1 * 9/2002 Roesner ..... 210/163
2002/0130083 A1 * 9/2002 Middleton et al. ..... 210/660
2002/0144338 A1 * 10/2002 Delanzo ..... 4/286
2003/0053862 A1 * 3/2003 Shaw et al. ..... 405/40
2003/0217955 A1 * 11/2003 Strawser, Sr. ..... 210/163
2004/0047687 A1 * 3/2004 Sychra ..... 405/30
2004/0065601 A1 * 4/2004 Martinez ..... 210/97
2004/0200767 A1 10/2004 Singleton
2004/0232057 A1 * 11/2004 Orozco et al. ..... 210/86
2005/0000872 A1 * 1/2005 Middleton et al. ..... 210/163
2005/0199537 A1 * 9/2005 Kluge ..... 210/164
2006/0032804 A1 * 2/2006 McPhillips ..... 210/205
2006/0049085 A1 * 3/2006 Parker ..... 210/163
2006/0091049 A1 * 5/2006 Hurst et al. ..... 210/163
2007/0045162 A1 * 3/2007 Hurst et al. ..... 210/163
2007/0090033 A1 * 4/2007 Kelley et al. ..... 210/163
2007/0131597 A1 * 6/2007 Chen ..... 210/164
2007/0144954 A1 * 6/2007 Neuber ..... 210/163
2007/0205144 A1 * 9/2007 Robinson ..... 210/163
2007/0237580 A1 * 10/2007 Sulak et al. ..... 404/25
2007/0262030 A1 * 11/2007 Meng Fei et al. ..... 210/767
2007/0266486 A1 * 11/2007 Ramirez ..... 4/309
2007/0295652 A1 * 12/2007 Kent ..... 210/164
2008/0006568 A1 * 1/2008 Moody et al. ..... 210/164
2008/0017563 A1 * 1/2008 Cook et al. ..... 210/164
2008/0093280 A1 * 4/2008 Kang ..... 210/163
2008/0145150 A1 * 6/2008 Shaw et al. ..... 405/52
2008/0149544 A1 * 6/2008 Shaw et al. ..... 210/163
2008/0277324 A1 * 11/2008 Meyers ..... 210/164
2008/0296211 A1 * 12/2008 Swan ..... 210/163
2010/0006487 A1 * 1/2010 Belasco ..... 210/164
2010/0025312 A1 * 2/2010 Martin ..... 210/170.03
2010/0187169 A1 * 7/2010 Hilton et al. ..... 210/163
2010/0288684 A1 * 11/2010 Lopez ..... 210/163
2010/0288685 A1 * 11/2010 Meyers ..... 210/164
2011/0049027 A1 * 3/2011 Rueda ..... 210/163

* cited by examiner

STORM DRAIN PROTECTOR

REFERENCE TO RELATED APPLICATION

This application claims the benefit of U.S. Provisional Patent Application No. 61/237,230, filed Aug. 26, 2009, the disclosure of which is incorporated herein.

BACKGROUND OF THE INVENTION

1. Field of the Invention

This invention describes a storm drain protector used to filter storm water runoff of sediment and other debris so that such materials do not clog the drain, hinder flow or pollute the body of water to which such drains ultimately flow.

2. Description of Related Art

Storm drains, commonly located in roadways, parking lots or beside sidewalks, are ordinarily covered by a simple metal grating that serves the dual purpose of preventing large debris from entering the drain and providing a barrier for pedestrians and animals. Such a grating does not filter anything but the largest of debris and is easily clogged when such large materials amass and cover the opening. Where there is a potential for large amounts of sediment or debris being washed into the drain, such as near a construction site, there exists a need for additional protection and filtration for the storm drain. This need is augmented by the fact that runoff water is often directly channeled to the ocean or other public bodies of water. Public safety and recent environmental regulation prohibiting the contamination of such resources, now requires that water entering storm drains not be polluted.

Numerous products have been used to prevent sediment or other materials from flowing into storm drains in such situations. U.S. Pat. No. 7,481,921, granted to Kent on Jan. 27, 2009, discloses a cleanable and reusable fibrous mat adapted to filter water that is placed over the top of a preexisting grating on a storm drain. Unfortunately, storm drains are subject to variable flow rates, with very high rates being common. Although the Kent apparatus succeeds in preventing the passage of sediment and small debris that would otherwise bypass the grating, it is likely that such a fibrous mat would need to be continuously cleaned and would quickly clog in high flow situations or if left untended for any significant period of time. Moreover, the Kent apparatus provides no method of filtering liquid contaminants, such as motor oil, that may commonly find their way to storm drains.

Another type of storm drain filter device is disclosed in U.S. Pat. No. 7,156,987, issued to Sanguinetti on Jan. 2, 2007. Sanguinetti describes a flexible, frameless filter bag. In this system, the metal storm drain grating is removed and placed into a filter bag capable of filtering in-flowing water. The grating, now wrapped in the bag, is then placed back into the drain. The bag is removed and emptied when it becomes filled with silt and debris. While the Sanguinetti device addresses the need to make such devices easily cleaned and installed, as with Kent, the Sanguinetti device has the disadvantage that it quickly becomes clogged and must be continuously cleaned to maintain flow into the drain. Kent also does not address the problem of potential liquid pollutants.

As is shown by the foregoing art, despite a long felt need, none of the prior approaches to preventing sediment and debris from entering storm drains have been able to effectively filter such materials in a way that prevents the filtering apparatus from quickly becoming clogged in high flow situations. Moreover, none of the prior approaches has been effective in substantially preventing liquid pollutants, such as motor oil, from passing into storm drains.

SUMMARY OF THE INVENTION

This invention provides a storm drain protector with a top layer having a generally horizontal surface in which there is at least one hole that allows water to pass vertically through the surface. The horizontal surface also has several vertical projections emanating from the surface that permit the passage of water over the surface while impeding the passage of debris.

In various alternative embodiments, the first layer is square, rectangular, circular, oval or is of a shape intended to fit a curbside drain. In the latter configuration, the protector has a substantially vertical surface that is contiguous with the horizontal surface. In still further embodiments, the hole has edges that protrude above the horizontal surface, there is more than one hole, there is a central hole having a diameter of at least about four inches. Another embodiment would have at least one depression in the horizontal surface.

Other possible embodiments include the addition of a screen layer that allows the passage of water through the hole but impedes the passage of debris. In another embodiment, this screen layer is affixed beneath the first layer or is fastened to the first layer through any suitable method known to the art, such as sewing, stapling, gluing or fusing. The screen layer may also be a mesh and that mesh has openings of at least about an eighth of an inch.

In another preferred embodiment, the storm drain protector has a water permeable layer, which can be formed of a matted material, such as felt. The water permeable layer may, alternatively, be water permeable foam. A water permeable layer may be employed that absorbs, binds, or otherwise impedes the passage of hydrocarbons with the drain water. Such a layer may also be fastened to the first layer through various means, including sewing, stapling, gluing or fusing.

In one embodiment, the first layer is manufactured by stamping, molding or extruding. In another, it is made of rubber or of a synthetic plastic. The projections are preferrably at least about one-half of an inch or, in a different embodiment, at least about three-quarters of an inch in height. In another embodiment the projections are conical, though in a separate embodiment they are cylindrical.

In a preferred embodiment, the projections are regularly spaced over the horizontal surface and where so spaced, they are preferably about one-half inch apart, though greater or lesser distances may be preferred, depending on the usage and type of debris.

Alternatively, the projections may be randomly or irregularly spaced along the horizontal surface.

BRIEF DESCRIPTION OF THE DRAWINGS

A more complete understanding of the present invention and the attendant features and advantages thereof may be had by reference to the following detailed description when considered in conjunction with the accompanying drawings wherein.

DETAILED DESCRIPTION OF THE INVENTION

The invention provides for a storm drain protector formed of a first, or top, layer forming a horizontal surface with a series of vertical projections and perforations, or holes, through which drain water can flow. The vertical projections of the top layer allow the passage of water over the surface, but are designed to create a barrier that prevents debris carried with the drain water from entering onto the surface and clogging the drain holes.

The storm drain protector includes a screening layer of fine pore filtering material able to trap larger sediment or other solid debris, and may include a layer of material able to filter out even finer sediment, and possibly forming a barrier to the passage of liquid hydrocarbons.

Vertical depressions in the surface are designed to trap sediment so as to prevent them from building up in the fine pores and, likewise, clogging the drain.

Before the present invention is described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Unless defined otherwise, all technical and scientific terms used herein have the same meaning as commonly understood by one of ordinary skill in the art to which this invention belongs. Although any materials similar or equivalent to those described herein can also be used in the practice or testing of the present invention, the preferred methods and materials are now described.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 1:
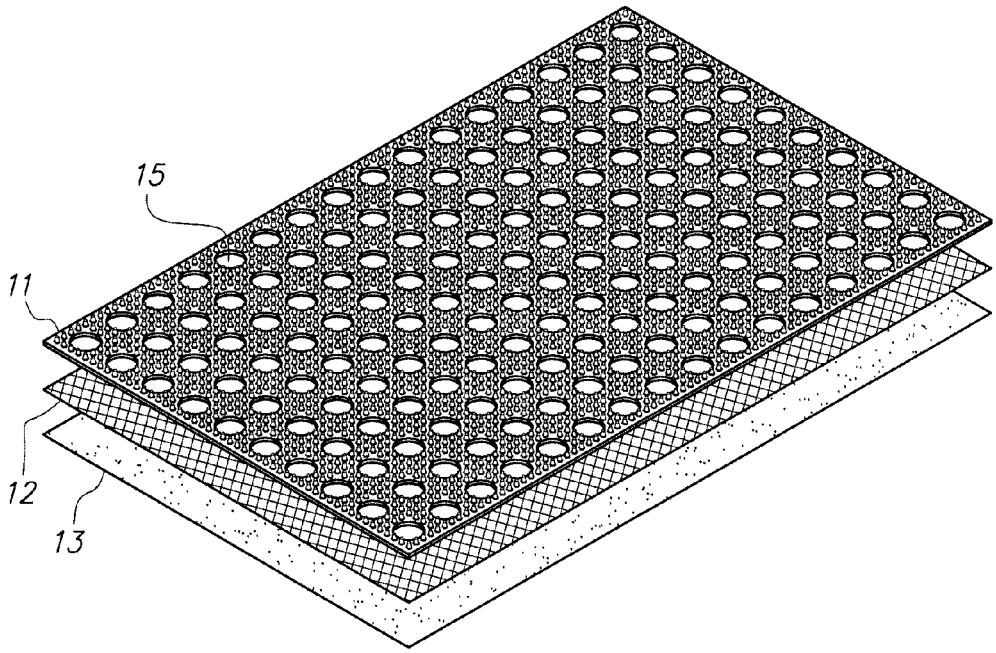
FIG. 1 shows a perspective view of a first embodiment of the invention with layers separated.
Figure 2:
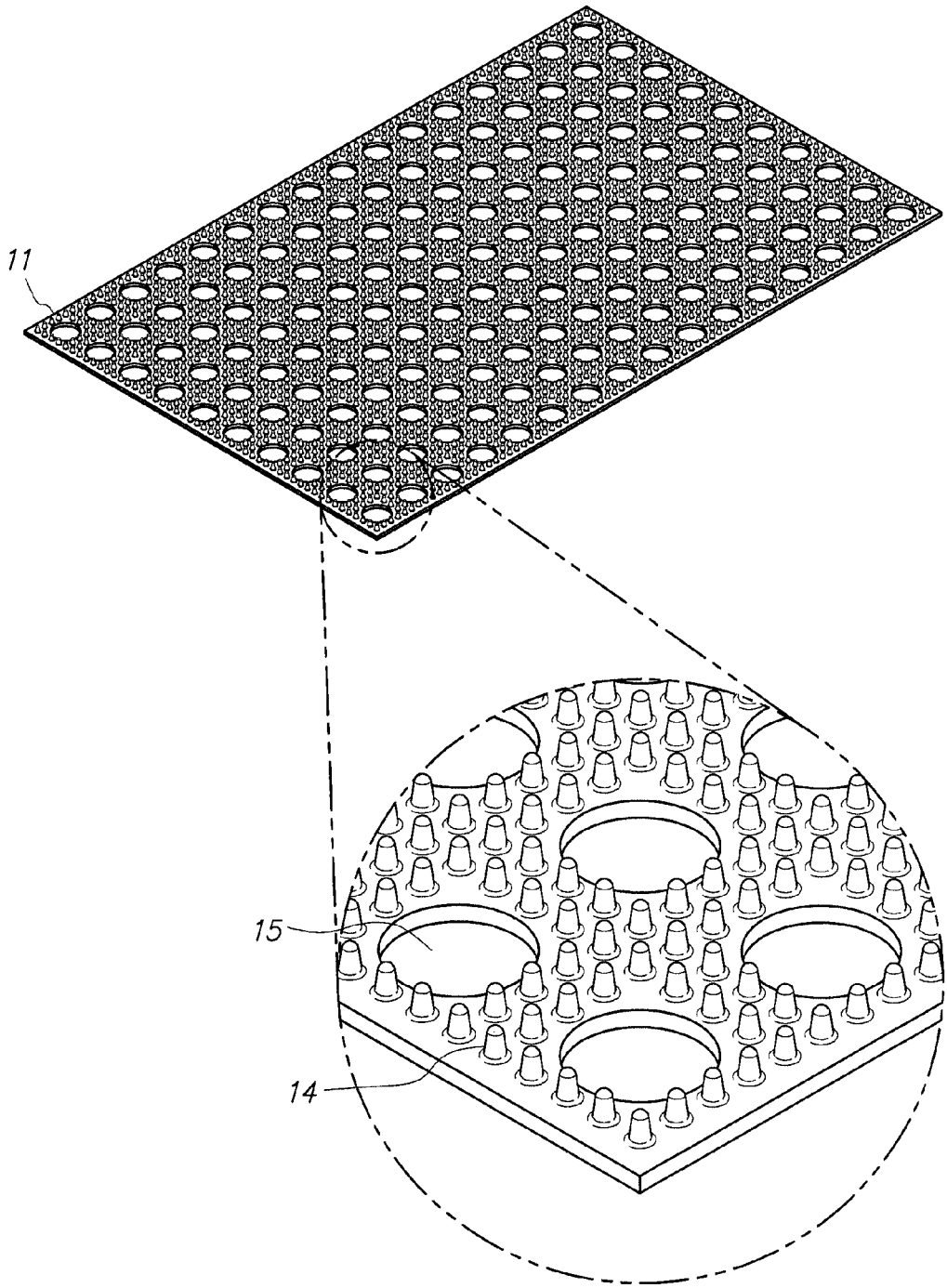
FIG. 2 is a perspective view of the top layer of the first embodiment of the invention, including a close-up view.

In a first embodiment, as shown in FIG. 1, the storm drain protector is rectangular and has three layers 11, 12, 13. The first or top layer 11, as shown in FIG. 2, is a rubber or extruded plastic mat having small (approximately a half inch tall) projections 14 and perforations 15 (approximately a half inch wide) over its entire surface area. The second or center layer 12 is composed of a screen or mesh, having apertures of approximately one-eighth of an inch or greater. The third or bottom layer 13 is composed of a lightweight and very dense felt material, having hydrophobic properties. These three layers are sewn together at the edges or otherwise fastened together and act as a single barrier that is laid over the conventional metal grating of a storm drain.

Figure 3:
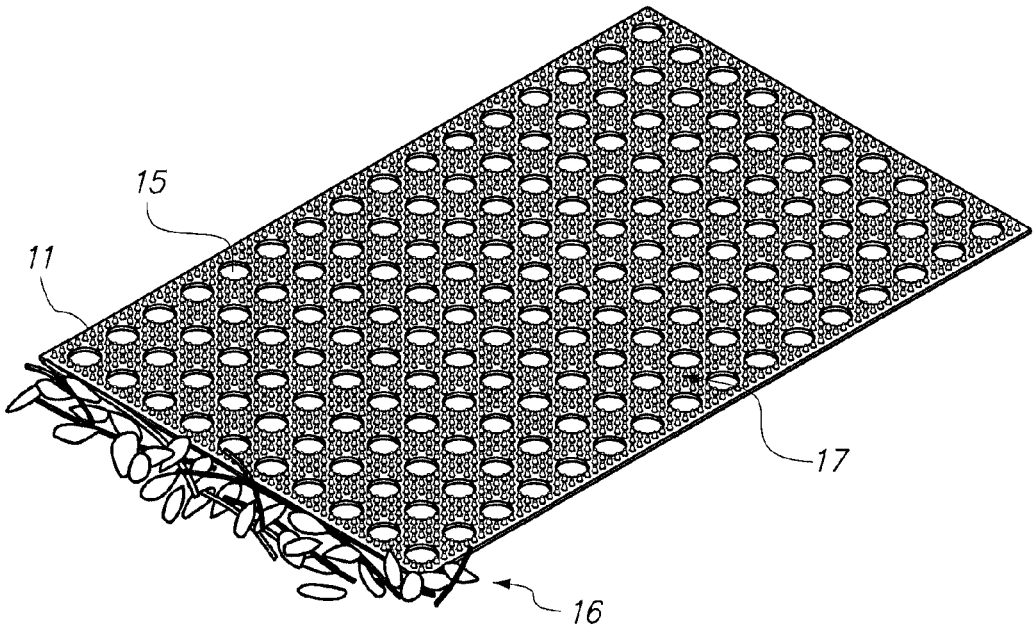
FIG. 3 depicts a perspective view of the first embodiment of the invention in use.

In operation, as shown in FIG. 3, water, having debris and sediment, flows horizontally toward the protector. Upon encountering the protector's edge, large debris and sediment 16 is blocked from moving horizontally over the top surface 17 of the mat by the projections 14. Water, meanwhile, continues the flow through and over the blocked debris, over the top of the mat and through the perforations 15 in the center of the mat. Eventually, the debris and sediment 17 at the edges of the protector builds up and provides a further barrier to additional debris flowing toward the protector. Periodically, such debris may be removed with a rake using a similar method. Advantageously, and unlike prior attempted solutions, this design allows the protector to stop large debris before it arrives at the perforations 15 preventing these perforations 15 from being blocked and the protector clogged. Moreover, as opposed to a design in which water might enter a drain horizontally, in this design, much of the debris is stopped while it is slowly moving in a horizontal direction, allowing gravity to assist in the blocking of debris. Yet water still enters the drain vertically, allowing gravity to speed the flow.

Water passing through the perforations may contain debris and sediment small enough to flow with the water past the projections 14. The second screen layer 12 filters such materials while allowing water to pass through. Finally, the bottom layer 13 is intended to allow water to pass but provides a barrier to oils and other non-water soluble liquid contaminants.

Figure 4:
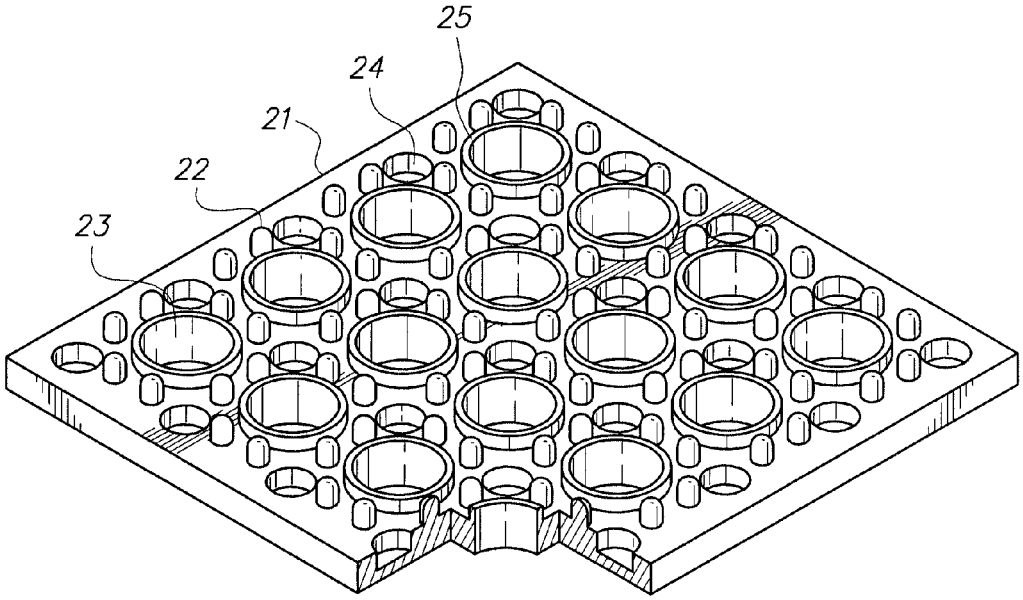
FIG. 4 shows a close-up view of the top layer of a second embodiment, including a cut-away view.

In a second embodiment, shown in FIG. 4, in addition to the top layer having small projections 22 and perforations 23, the mat also has small (approximately half inch wide) depressions 24. These depressions 24 serve as a trap into which may fall medium sized sediment particles that would otherwise flow through the perforations 23 and be filtered out by the middle or bottom layer. It is advantageous to trap such material on the surface of the mat so that it does not impede the flow of water through the other layers.

This embodiment also shows the perforations having an edge 25 that projects above the flat surface of the top layer 21. The edge 25 forms a further barrier to fine debris or sediment flowing into the perforations 23.

Figure 5:
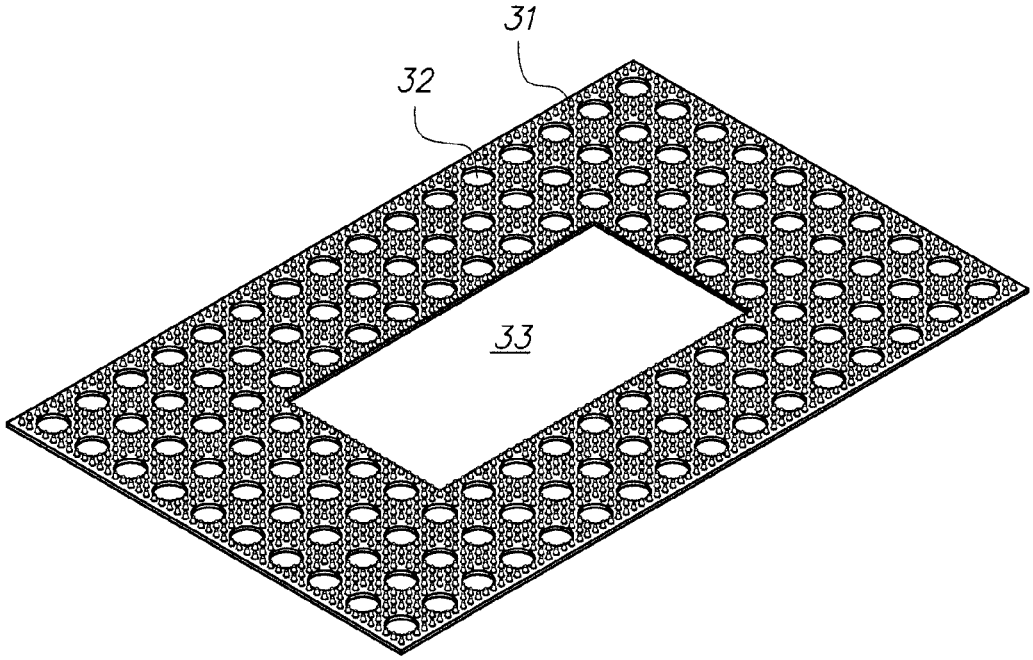
FIG. 5 is a perspective view of the top layer of a third embodiment.

In the embodiment shown in FIG. 5, in addition to or in place of the multiple perforations 32 of the top layer 31, there is a large hole 33 in the top layer 31 at or near its center that is of relatively greater size, i.e., greater that four inches across. Such an embodiment is advantageous in high water flow situations where the small perforations of other embodiments would not provide a sufficient flow rate through the storm drain protector.

Figure 6:
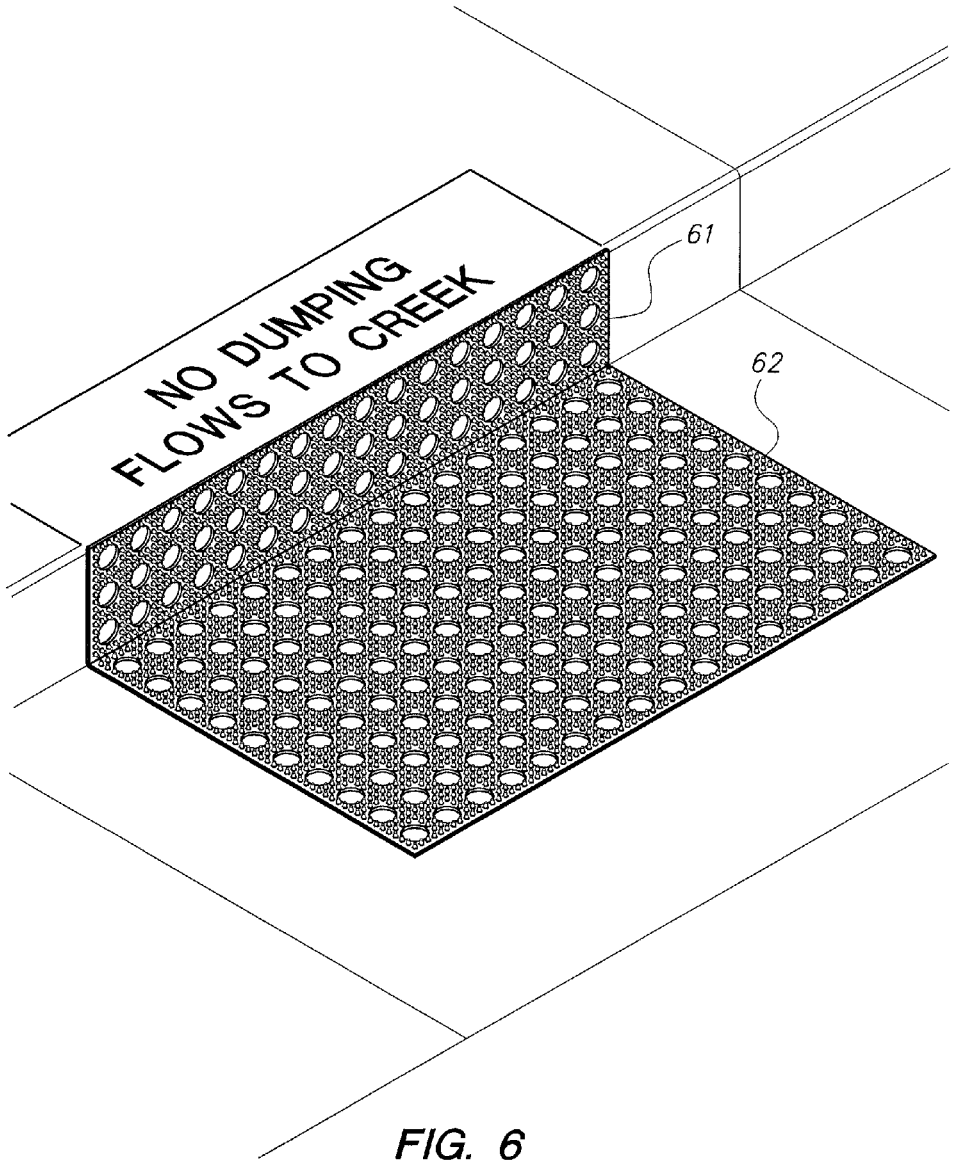
FIG. 6 shows a perspective view of a variation of prior embodiments in place on a storm drain.

In addition to these embodiments, the invention contemplates additional variations upon these embodiments, including various different rectangular sizes and circular versions, also of different diameters. These variations are sized to allow slightly overlapping coverage of storm drains having various shapes and sizes. Another variation, shown in FIG. 6, is one composed of two flat surfaces 61, 62 perpendicularly joined so as to fit over a curbside drain.

The invention also contemplates different layers depending on the likely contaminants of the runoff water at a particular location. Such layers could include a water permeable filter, such as a charcoal filter, and a synthetic foam rubber filter. Such layers may be grouped in any combination that is appropriate given the nature of the potential contaminants, the level of filtering that is deemed necessary and the expected flow rate.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. In a curb inlet storm drain having a grate, the improvement comprising:

a storm drain protector having:

a first, top layer comprising a generally horizontal surface having a plurality of holes formed therein, and a plurality of substantially vertical projections emanating from said horizontal surface, wherein said holes allow passage of water vertically through said first layer, and wherein said vertical projections extend a height sufficient to prevent passage of debris across said top layer while permitting passage of water over said horizontal surface, thereby preventing the drain inlet from being clogged;

a center layer composed of a screen or mesh having apertures of approximately one-eighth inch or greater in diameter; and a third layer composed of a felt material having hydrophobic properties;

wherein said first, second and third layers are fastened together and act as a single barrier that is coextensively laid over said grate.

* * * * *